United States Patent [19]

Kukes et al.

[11] Patent Number: 4,578,179

[45] Date of Patent: Mar. 25, 1986

[54] HYDROFINING PROCESS FOR HYDROCARBON CONTAINING FEED STREAMS

[75] Inventors: Simon G. Kukes; Marvin M. Johnson; Daniel J. Strope; Robert J. Hogan, all of Bartlesville, Okla.

[73] Assignee: Phillips Petroleum Company, Bartlesville, Okla.

[21] Appl. No.: 553,445

[22] Filed: Nov. 18, 1983

[51] Int. Cl.[4] ..... C10G 45/04; C10G 45/08; C10G 47/06; C10G 47/12

[52] U.S. Cl. ..... 208/110; 208/111; 208/216 R; 208/251 H; 208/254 H

[58] Field of Search ..... 208/112, 108, 216 R, 208/251 H, 254 H, 110, 111; 502/117, 220

[56] References Cited

U.S. PATENT DOCUMENTS

| | | | |
|---|---|---|---|
| 3,032,513 | 5/1962 | Tornqvist et al. | 502/104 |
| 3,161,585 | 12/1964 | Gleim et al. | 208/264 |
| 3,196,104 | 7/1965 | Gleim et al. | 208/264 |
| 3,228,993 | 1/1966 | Kozlowski et al. | 208/254 H |
| 3,331,769 | 7/1967 | Gatsis | 208/210 |
| 3,474,029 | 10/1969 | Gleim | 208/251 H |
| 4,134,825 | 1/1979 | Bearden, Jr. et al. | 208/108 |
| 4,243,553 | 1/1981 | Naumann et al. | 502/220 |
| 4,243,554 | 1/1981 | Naumann et al. | 502/220 |
| 4,244,839 | 1/1981 | Aldridge et al. | 502/170 |
| 4,271,323 | 6/1981 | Durand et al. | 502/117 |
| 4,303,634 | 12/1981 | Gatsis | 502/220 |
| 4,389,301 | 6/1983 | Dahlberg et al. | 208/59 |
| 4,430,207 | 2/1984 | Kukes | 208/251 H |
| 4,430,442 | 2/1984 | Sawyer et al. | 502/220 |
| 4,430,443 | 2/1984 | Seiver et al. | 502/164 |
| 4,431,747 | 2/1984 | Seiver et al. | 502/220 |
| 4,435,277 | 3/1984 | Dinh et al. | 208/108 |

FOREIGN PATENT DOCUMENTS 2066842 7/1981 United Kingdom .

OTHER PUBLICATIONS

Alper et al., "Removal of Sulfur from Fuels by Molybdenum Hexacarbonyl on Silica", *Fuel 59,* p. 670.

Alper et al., "Use of Molybdenum Carbonyl . . . ", *Fuel 61,* p. 1164.

*Primary Examiner*—John Doll

*Assistant Examiner*—O. Chaudhuri

*Attorney, Agent, or Firm*—French and Doescher

[57] ABSTRACT

A treated decomposable compound of molybdenum, which has been prepared by the catalytic hydrogenation of a decomposable compound of molybdenum, wherein the molybdenum has a valence state greater than zero, or by the treating of the decomposable compound of molybdenum with a reducing agent, is mixed with a hydrocarbon-containing feed stream. The hydrocarbon-containing feed stream containing such treated decomposable compound of molybdenum is then contacted with a catalyst composition comprising a support selected from the group consisting of alumina, silica and silica alumina and a promoter comprising at least one metal selected from the group consisting of Group VIB, Group VIIB, and Group VIII of the Periodic Table to reduce the concentration of metals, sulfur, nitrogen, Ramsbottom carbon residue and/or heavies contained in the hydrocarbon-containing feed stream.

19 Claims, No Drawings

HYDROFINING PROCESS FOR HYDROCARBON CONTAINING FEED STREAMS

This invention relates to a hydrofining process for hydrocarbon-containing feed streams, to a composition useful in a hydrofining process and to methods for producing a composition useful in a hydrofining process. In one aspect, this invention relates to a process for removing metals from a hydrocarbon-containing feed stream. In another aspect, this invention relates to a process for removing sulfur or nitrogen from a hydrocarbon-containing feed stream. In still another aspect, this invention relates to a process for removing potentially cokeable components from a hydrocarbon-containing feed stream. In still another aspect, this invention relates to a process for reducing the amount of heavies in a hydrocarbon-containing feed stream.

It is well known that crude oil as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalysts employed in processes such as catalytic cracking, hydrogenation or hydrodesulfurization.

The presence of other components such as sulfur and nitrogen is also considered detrimental to the processability of a hydrocarbon-containing feed stream. Also, hydrocarbon-containing feed streams may contain components (referred to as Ramsbottom carbon residue) which are easily converted to coke in processes such as catalytic cracking, hydrogenation or hydrodesulfurization. It is thus desirable to remove components such as sulfur and nitrogen and components which have a tendency to produce coke.

It is also desirable to reduce the amount of heavies in the heavier fractions such as the topped crude and residuum. As used herein the term heavies refers to the fraction having a boiling range higher than about 1000° F. This reduction results in the production of lighter components which are of higher value and which are more easily processed.

It is thus an object of this invention to provide a process to remove components such as metals, sulfur, nitrogen and Ramsbottom carbon residue from a hydrocarbon-containing feed stream and to reduce the amount of heavies in the hydrocarbon-containing feed stream (one or all of the described removals and reduction may be accomplished in such process, which is generally referred to as a hydrofining process, depending on the components contained in the hydrocarbon-containing feed stream). Such removal or reduction provides substantial benefits in the subsequent processing of the hydrocarbon containing feed streams. It is also an object of this invention to provide a composition useful in a hydrofining process.

In accordance with the present invention, a hydrocarbon-containing feed stream, which also contains metals, sulfur, nitrogen and/or Ramsbottom carbon residue, is contacted with a solid catalyst composition comprising alumina, silica or silica-alumina. The catalyst composition also contains at least one metal selected from Group VIB, Group VIIB, and Group VIII of the Periodic Table, in the oxide or sulfide form. At least one decomposable compound of molybdenum, which has been catalytically hydrogenated or treated with a reducing agent to produce a composition useful in a hydrofining process (such a decomposable compound of molybdenum is sometimes referred to hereinafter as a "treated molybdenum compound") is mixed with the hydrocarbon-containing feed stream prior to contacting the hydrocarbon-containing feed stream with the catalyst composition. The hydrocarbon-containing feed stream, which also contains the treated molybdenum compound, is contacted with the catalyst composition in the presence of hydrogen under suitable hydrofining conditions. After being contacted with the catalyst composition, the hydrocarbon-containing feed stream will contain a significantly reduced concentration of metals, sulfur, nitrogen and Ramsbottom carbon residue as well as a reduced amount of heavy hydrocarbon components. Removal of these components from the hydrocarbon-containing feed stream in this manner provides an improved processability of the hydrocarbon-containing feed stream in processes such as catalytic cracking, hydrogenation or further hydrodesulfurization. Use of the treated molybdenum compound results in improved removal of metals.

Other objects and advantages of the invention will be apparent from the foregoing brief description of the invention and the appended claims as well as the detailed description of the invention which follows.

The catalyst composition used in the hydrofining process to remove metals, sulfur, nitrogen and Ramsbottom carbon residue and to reduce the concentration of heavies comprises a support and a promoter. The support comprises alumina, silica, or silica-alumina. Suitable supports are believed to be $Al_2O_3$, $SiO_2$, $Al_2O_3$—$SiO_2$, $Al_2O_3$—$TiO_2$, $Al_2O_3$—$BPO_4$, $Al_2O_3$—$AlPO_4$, $Al_2O_3$—$Zr_3(PO_4)_4$, $Al_2O_3$—$SnO_2$ and $Al_2O_3$—ZnO. Of these supports, $Al_2O_3$ is particularly preferred.

The promoter comprises at leastd one metal selected from the group consisting of the metals of Group VIB, Group VIIB, and Group VIII of the Periodic Table. The promoter will generally be present in the catalyst composition in the form of an oxide or sulfide. Particularly suitable promoters are iron, cobalt, nickel, tungsten, molybdenum, chromium, manganese, vanadium and platinum. Of these promoters, cobalt, nickel, molybdenum and tungsten are the most preferred. A particularly preferred catalyst composition is $Al_2O_3$ promoted by CoO and $MoO_3$ or promoted by CoO, NiO and $MoO_3$.

Generally, such catalysts are commercially available. The concentration of cobalt oxide in such catalysts is typically in the range of about 0.5 weight percent to about 10 weight percent based on the weight of the total catalyst composition. The concentration of molybdenum oxide is generally in the range of about 2 weight percent to about 25 weight percent based on the weight of the total catalyst composition. The concentration of nickel oxide in such catalysts is typically in the range of about 0.3 weight percent to about 10 weight percent based on the weight of the total catalyst composition. Pertinent properties of four commercial catalysts which are believed to be suitable are set forth in Table I.

TABLE I

| Catalyst | CoO (Wt. %) | $MoO_3$ (Wt. %) | NiO (Wt. %) | Bulk Density* (g/cc) | Surface Area ($m^2/g$) |
|---|---|---|---|---|---|
| Shell 344 | 2.99 | 14.42 | — | 0.79 | 186 |
| Katalco 477 | 3.3 | 14.0 | — | .64 | 236 |
| KF - 165 | 4.6 | 13.9 | — | .76 | 274 |
| Commercial Catalyst D Harshaw Chemical Company | 0.92 | 7.3 | 0.53 | — | 178 |

*Measured on 20/40 mesh particles, compacted.

The catalyst composition can have any suitable surface area and pore volume. In general, the surface area will be in the range of about 2 to about 400 $m^2/g$, preferably about 100 to about 300 $m^2/g$, while the pore volume will be in the range of about 0.1 to about 4.0 cc/g, preferably about 0.3 to about 1.5 cc/g.

Presulfiding of the catalyst is preferred before the catalyst is initially used. Many presulfiding procedures are known and any conventional presulfiding procedure can be used. A preferred presulfiding procedure is the following two step procedure.

The catalyst is first treated with a mixture of hydrogen sulfide in hydrogen at a temperature in the range of about 175° C. to about 225° C., preferably about 205° C. The temperature in the catalyst composition will rise during this first presulfiding step and the first presulfiding step is continued until the temperature rise in the catalyst has substantially stopped or until hydrogen sulfide is detected in the effluent flowing from the ractor. The mixture of hydrogen sulfide and hydrogen preferably contains in the range of about 5 to about 20 percent hydrogen sulfide, preferably about 10 percent hydrogen sulfide.

The second step in the preferred presulfiding process consists of repeating the first step at a temperature in the range of about 350° C. to about 400° C., preferably about 370° C., for about 2–3 hours. It is noted that other mixtures containing hydrogen sulfide may be utilized to presulfide the catalyst. Also the use of hydrogen sulfide is not required. In a commercial operation, it is common to utilize a light naphtha containing a sulfur compound to presulfide the catalyst.

Any suitable hydrocarbon-containing feed stream may be hydrofined using the above described catalyst composition in accordance with the present invention. Suitable hydrocarbon-containing feed streams include petroleum products, coal, pyrolyzates, products from extraction and/or liquefaction of coal and lignite, products from tar sands, products from shale oil and similar products. Suitable hydrocarbon feed streams include gas oil having a boiling range from about 205° C. to about 538° C., topped crude having a boiling range in excess of about 343° C. and residuum. However, the present invention is particularly directed to heavy feed streams such as heavy topped crudes and residuum and other materials which are generally regarded as too heavy to be distilled. These materials will generally contain the highest concentrations of metals, sulfur, nitrogen and Ramsbottom carbon residues.

It is believed that the concentration of any metal in the hydrocarbon-containing feed stream can be reduced using the above described catalyst composition in accordance with the present invention. However, the present invention is particularly applicable to the removal of vanadium, nickel and iron.

The sulfur which can be removed using the above described catalyst composition in accordance with the present invention will generally be contained in organic sulfur compounds. Examples of such organic sulfur compounds, include sulfides, disulfides, mercaptans, thiophenes, benzothiophenes, dibenzothiophenes and the like.

The nitrogen which can be removed using the above described catalyst composition in accordance with the present invention will also generally be contained in organic nitrogen compounds. Examples of such organic nitrogen compounds include amines, diamines, pyridines, quinolines, porphyrins, benzoquinolines and the like.

While the above described catalyst composition is effective for removing some metals, sulfur, nitrogen and Ramsbottom carbon residue, the removal of metals can be significantly improved in accordance with the present invention by introducing a treated molybdenum compound into the hydrocarbon-containing feed stream prior to contacting the hydrocarbon-containing feed stream with the catalyst composition.

As has been previously stated, the treated molybdenum compound is prepared by catalytically hydrogenating a decomposable compound of molybdenum or by treating a decomposable compound of molybdenum with a reducing agent. Any suitable decomposable compound of molybdenum can be catalytically hydrogenated or treated with a reducing agent. However, it is believed that the catalytically hydrogenation or treatment with a reducing agent results in a reduction of the valence state of the molybdenum in the decomposable metal compound and that this reduction in valence state is at least one factor which provides the improvement demonstrated by the present invention. Thus, decomposable metal compounds where the molybdenum is in a valence state of zero are not considered suitable since it is not believed that any benefit would be obtained by catalytically hydrogenating such decomposable molybdenum compounds or treating such decomposable molybdenum compounds with a reducing agent.

Examples of suitable decomposable molybdenum compounds are aliphatic, cycloaliphatic and aromatic carboxylates having 1–20 carbon atoms, diketones, mercaptides, xanthates, carbonates and dithiocarbamates, wherein the valence of molybdenum can range from 1+ to 6+. Preferred decomposable molybdenum compounds are molybdenum (IV) carboxylates such as molybdenum (IV) octoate.

The catalytic hydrogenation of the decomposable compound of molybdenum can be carried out by means of any apparatus whereby there is achieved a contact of the hydrogenation catalyst with the decomposable compound of molybdenum and hydrogen.

Any suitable hydrogenation catalyst can be utilized in the catalytic hydrogenation of the decomposable compound of molybdenum. Examples of suitable hydrogenation catalyst are Raney nickel; alumina or silica impregnated with Ni, Co, Pt, Pd, Ru, Rh, Cr, or Cu; copper chromite and nickel boride. A preferred hydrogenation catalyst is an aluminia catalyst promoted with nickel.

Any suitable hydrogenation reaction time may be used in the catalytic hydrogenation of the decomposable compound of molybdenum. The hydrogenation reaction time will generally be in the range of about 0.5 hours to about 4 hours, and will vary with the amount and activity of the catalyst.

Any suitable hydrogenation temperature can be employed in the hydrogenation of the decomposable compound of molybdenum. The hydrogenation temperature will generally be in the range of about 100° C. to about 300° C.

The hydrogenation of the decomposable compound of molybdenum can be carried out at any suitable pressure. The pressure of the hydrogenation reaction will generally be in the range of about 50 psig to about 1000 psig.

Any suitable quantity of hydrogen can be added to the hydrogenation process. The quantity of hydrogen used to contact the decomposable compound of molybdenum will generally be in the range of about 1 to about 10 moles $H_2$ per gram atom of chemically bound molybdenum.

The treatment of the decomposable compound of molybdenum with a reducing agent can be carried out by means of any apparatus whereby there is achieved a contact of the decomposable compound of molybdenum with the reducing agent.

Any suitable reducing agent may be utilized to treat the decomposable compound of molybdenum. Examples of suitable reducing agents are hydrocarbyl aluminum compounds such as trimethyl aluminum, triethyl aluminum, tripropyl aluminum, tributyl aluminum and the like; and metal hydrides such as $LiBH_4$, $NaBH_4$, $LiAlH_4$, $LiGaH_4$, $Al_2H_2(CH_3)_4$ and the like. A particularly preferred reducing agent is triethyl aluminum.

The decomposable compound of molybdenum may be contacted with the reducing agent for any suitable time. Contact time will generally be in the range of about 1 second to about 1 hour, preferably 1–5 minutes.

Any suitable temperature can be employed while contacting the decomposable compound of molybdenum with the reducing agent. The temperature will generally be in the range of from about 20° C. to about 100° C.

The contacting of the decomposable compound of molybdenum with the reducing agent can be carried out at any suitable pressure. The pressure will generally be in the range of about 15 psia to about 150 psia.

The contacting of the decomposable compound of molybdenum with the reducing agent may be carried out under any suitable atmosphere. An inert atmosphere such as nitrogen is preferred.

It is again noted that it is believed that both the catalytic hydrogenation and the treatment with the reducing agent result in a reduction of the valence state of molybdenum in the treated decomposable compound of molybdenum. The term reducing agent is used because of this belief and because these agents are generally referred to as reducing agents. However, a reduction in the valence state has not been actually proved by any analytical technique and the present invention is not limited to reducing the valence state. Rather, the present invention resides in the discovery that treated molybdenum compounds can be used to improve a demetallization process.

Any suitable concentration of the treated molybdenum compound may be added to the hydrocarbon-containing feed stream. In general, a sufficient quantity of the additive will be added to the hydrocarbon-containing feed stream to result in a concentration of molybdenum metal in the range of about 1 to about 60 ppm and more preferably in the range of about 2 to about 20 ppm.

High concentrations such as about 100 ppm and above, particularly about 360 ppm and above, should be avoided to prevent plugging of the reactor. It is noted that one of the particular advantages of the present invention is the very small concentrations of molybdenum which result in a significant improvement. This substantially improves the economic viability of the process.

After the treated molybdenum compound has been added to the hydrocarbon-containing feed stream for a period of time, it is believed that only periodic introduction of the additive is required to maintain the efficiency of the process.

The treated molybdenum compound may be combined with the hydrocarbon-containing feed stream in any suitable manner. The treated molybdenum compound may be mixed with the hydrocarbon-containing feed stream as a solid or liquid or may be dissolved in a suitable solvent (preferably an oil) prior to introduction into the hydrocarbon-containing feed stream. Any suitable mixing time may be used. However, it is believed that simply injecting the treated molybdenum compound into the hydrocarbon-containing feed stream is sufficient. No special mixing equipment or mixing period are required.

The pressure and temperature at which the treated molybdenum compound is introduced into the hydrocarbon-containing feed stream is not thought to be critical. However, a temperature below 450° C. is recommended.

The hydrofining process can be carried out by means of any apparatus whereby there is achieved a contact of the catalyst composition with the hydrocarbon containing feed stream and hydrogen under suitable hydrofining conditions. The hydrofining process is in no way limited to the use of a particular apparatus. The hydrofining process can be carried out using a fixed catalyst bed, fluidized catalyst bed or a moving catalyst bed. Presently preferred is a fixed catalyst bed.

Any suitable reaction time between the catalyst composition and the hydrocarbon-containing feed stream may be utilized. In general, the reaction time will range from about 0.1 hours to about 10 hours. Preferably, the reaction time will range from about 0.3 to about 5 hours. Thus, the flow rate of the hydrocarbon containing feed stream should be such that the time required for the passage of the mixture through the reactor (residence time) will preferably be in the range of about 0.3 to about 5 hours. This generally requires a liquid hourly space velocity (LHSV) in the range of about 0.10 to about 10 cc of oil per cc of catalyst per hour, preferably from about 0.2 to about 3.0 cc/cc/hr.

The hydrofining process can be carried out at any suitable temperature. The temperature will generally be in the range of about 150° to about 550° C. and will preferably be in the range of about 340° to about 440° C. Higher temperatures do improve the removal of metals but temperatures should not be utilized which will have adverse effects on the hydrocarbon-containing feed stream, such as coking, and also economic considerations must be taken into account. Lower temperatures can generally be used for lighter feeds.

Any suitable hydrogen pressure may be utilized in the hydrofining process. The reaction pressure will generally be in the range of about atmospheric to about 10,000 psig. Preferably, the pressure will be in the range of about 500 to about 3,000 psig. Higher pressures tend to reduce coke formation but operation at high pressure may have adverse economic consequences.

Any suitable quantity of hydrogen can be added to the hydrofining process. The quantity of hydrogen used to contact the hydrocarbon-containing feed stock will generally be in the range of about 100 to about 20,000 standard cubic feet per barrel of the hydrocarbon-containing feed stream and will more preferably be in the range of about 1,000 to about 6,000 standard cubic feet per barrel of the hydrocarbon-containing feed stream.

In general, the catalyst composition is utilized until a satisfactory level of metals removal fails to be achieved which is believed to result from the coating of the catalyst composition with the metals being removed. It is possible to remove the metals from the catalyst composition by certain leaching procedures but these procedures are expensive and it is generally contemplated that once the removal of metals falls below a desired level, the used catalyst will simply be replaced by a fresh catalyst.

The time in which the catalyst composition will maintain its activity for removal of metals will depend upon the metals concentration in the hydrocarbon-containing feed streams being treated. It is believed that the catalyst composition may be used for a period of time long enough to accumulate 10–200 weight percent of metals, mostly Ni, V, and Fe, based on the weight of the catalyst composition, from oils.

The following examples are presented in further illustration of the invention. The test procedure and procedure for preparing the treated molybdenum compound used are described prior to describing the examples.

TEST PROCEDURE

In this example, the automated experimental setup for investigating the hydrofining (primarily demetallizing) of heavy oils in accordance with the present invention is described. Oil, with or without a dissolved treated molybdenum compound, was pumped downward through an induction tube into a trickle bed reactor, 28.5 inches long and 0.75 inches in diameter. The oil pump used was a Whitey Model LP 10 (a reciprocating pump with a diaphragm-sealed head; marketed by Whitey Corp., Highland Heights, Ohio). The oil induction tube extended into a catalyst bed (located about 3.5 inches below the reactor top) comprising a top layer of 50 cc of low surface area $\alpha$-alumina (Alundum; surface area less than 1 $m^2$/gram; marketed by Norton Chemical Process Products, Akron, Ohio), a middle layer of 50 cc of a hydrofining catalyst and a bottom layer of 50 cc of $\alpha$-alumina.

The hydrofining catalyst used was a commercial, promoted desulfurization catalyst (referred to as catalyst D in table I) marketed by Harshaw Chemical Company, Beachwood, Ohio. The catalyst had an $Al_2O_3$ support having a surface area of 178 $m^2$/g (determined by BET method using $N_2$ gas), a medium pore diameter of 140 Å and at total pore volume of 0.682 cc/g (both determined by mercury porosimetry in accordance with the procedure described by American Instrument Company, Silver Springs, Md., catalog number 5-7125-13). The catalyst contained 0.92 weight-% Co (as cobalt oxide), 0.53 weight-% Ni (as nickel oxide); 7.3 weight-% Mo (as molybdenum oxide).

The catalyst was presulfided as follows. A heated tube reactor was filled with an 8 inch high bottom layer of Alundum, a 7–8 inch high middle layer of catalyst D, and an 11 inch top layer of Alundum. The reactor was purged with nitrogen and then the catalyst was heated for one hour in a hydrogen stream to about 400° F. While the reactor temperature was maintained at about 400° F., the catalyst was then exposed to a mixture of hydrogen (0.46 scfm) and hydrogen sulfide (0.049 scfm) for about two hours. The catalyst was heated for about one hour in the mixture of hydrogen and hydrogen sulfide to a temperature of about 700° F. The reactor temperature was maintained at 700° F. for two hours while the catalyst continued to be exposed to the mixture of hydrogen and hydrogen sulfide. The catalyst was then allowed to cool to ambient temperature conditions in the mixture of hydrogen and hydrogen sulfide and was finally purged with nitrogen.

Hydrogen gas was introduced into the reactor through a tube that concentrically surrounded the oil induction tube but extended only as far as the reactor top. The reactor was heated with a Thermcraft (Winston-Salem, N.C.) Model 211 3-zone furnace. The reactor temperature was measured in the catalyst bed at three different locations by three separate thermocouples embedded in an axial thermocouple well (0.25 inch outer diameter). The liquid product oil was generally collected every day for analysis. The hydrogen gas was vented. Vanadium and nickel contents were determined by plasma emission analysis. Sulfur content was measured by x-ray fluorescence spectrometry. Ramsbottom carbon residue was determined according to ASTM D524.

Undiluted heavy oil was used as the feed, either a Monagas pipeline oil or an Arabian heavy oil. In all demetallization runs the reactor temperature was about 407° C. (765° F.); the liquid hourly space velocity (LHSV) of the oil feed was about 1.0 cc/cc catalyst/hr; the total pressure was about 2250 psig; and the hydrogen feed rate was about 4800 SCF/bbl (standard cubic feet of the hydrogen per barrel of oil).

A desired amount of the decomposable molybdenum compounds used were introduced into the feed and intimately mixed by shaking. The resulting mixture was supplied through the oil induction tube to the reactor when desired.

PREPARATION OF TREATED MOLYBDENUM COMPOUNDS

In this example the treatment of a molybdenum (IV) carboxylate to prepare treated molybdenum compounds is described. Two treatment methods produced effective treated molybdenum compounds in accordance with the instant invention.

Method A: Treatment with Aluminum Alkyl 10.0 grams (about 0.011 moles) of an 8 weight-% solution of molybdenum (IV) octoate ($MoO(C_7H_{15}CO_2)_2$) (supplied by Shepherd Chemical Company, Cincinnati, Ohio), were mixed with 16 ml of 1-molar (0.016 moles) triethyl aluminum (TEA; supplied by Texas Alkyls, Deer Park, Tex.). This mixture was shaken in a sealed, thick-walled glass bottle under nitrogen at essentially atmospheric pressure and room temperature for about 2–3 minutes. The reaction mixture was then diluted with 10 ml of cyclohexane and kept under nitrogen. This molybdenum compound is referred to hereinafter as treated molybdenum compound A.

Method B: Catalytic Hydrogenation 40 grams of an 8-weight-% molybdenum (IV) octoate solution, 5 grams of a reduced and stabilized nickel-/alumina catalyst (Harshaw Ni-3266 F-20; 51.2 weight-% nickel; supplied by Harshaw Chemical Company, Beachwood, Ohio), and 95 grams of n-hexadecane were added to a stirred autoclave of 300 ml capacity. The filled autoclave was flushed with hydrogen and then heated at about 350° F. under a hydrogen pressure of about 600 psig for about 4 hours. At hourly intervals, when the pressure had decreased to about 520–540 psig, the vapor space above the solution was vented to atmospheric pressure and was repressurized with fresh hydrogen to about 600 psig. The vented gases were passed through cold traps and a total amount of about 3.5 ml of water was collected. The produced slurry containing treated Mo octoate was stored in a bottle under nitrogen. The metal content of this slurry, as determined by plasma emission analysis, was 3.063 weight-% Mo, 1.410 weight-% Al, 0.0698 weight-% Cu, 0.0698 weight-% Fe, and 0.0536 weight-% Ni, and 0.0107 weight-% P. This molybdenum compound is referred to hereinafter as treated molybdenum compound B.

EXAMPLE I

An Arabian heavy topped crude (650° F.+; containing about 30 ppm nickel, about 102 ppm vanadium) was hydrotreated in accordance with the described test procedure. The LHSV of the oil was about 1.0, the pressure was about 2250 psig, hydrogen feed rate was about 4,800 standard cubic feet (SCF) hydrogen per barrel of oil, and the temperature was about 765° F. (407° C.). The hydrofining catalyst was presulfided catalyst D.

In run 1 no molybdenum was added to the hydrocarbon feed. In run 2 untreated molybdenum (IV) octoate was added for 19 days. Then molybdenum (IV) octoate, which had been heated in a stirred autoclave at 635° F. for 4 hours in Monagas pipe line oil at a constant hydrogen pressure of 980 psig but in the absence of a hydrogenation catalyst, was added for 8 days. Results are summarized in Tables II and III.

TABLE II

| Days on Stream | PPM Mo in Feed | (Run 1), (Control) PPM in Product Oil Ni | V | Ni + V | % Removal of Ni + V |
|---|---|---|---|---|---|
| 1 | 0 | 13 | 25 | 38 | 71 |
| 2 | 0 | 14 | 30 | 44 | 67 |
| 3 | 0 | 14 | 30 | 44 | 67 |
| 6 | 0 | 15 | 30 | 45 | 66 |
| 7 | 0 | 15 | 30 | 45 | 66 |
| 9 | 0 | 14 | 28 | 42 | 68 |
| 10 | 0 | 14 | 27 | 41 | 69 |
| 11 | 0 | 14 | 27 | 41 | 69 |
| 13 | 0 | 14 | 28 | 42 | 68 |
| 14 | 0 | 13 | 26 | 39 | 70 |
| 15 | 0 | 14 | 28 | 42 | 68 |
| 16 | 0 | 15 | 28 | 43 | 67 |
| 19 | 0 | 13 | 28 | 41 | 69 |
| 20 | 0 | 17 | 33 | 50 | 62 |
| 21 | 0 | 14 | 28 | 42 | 68 |
| 22 | 0 | 14 | 29 | 43 | 67 |
| 23 | 0 | 14 | 28 | 42 | 68 |
| 25 | 0 | 13 | 26 | 39 | 70 |
| 26 | 0 | 9 | 19 | 28 | 79 |
| 27 | 0 | 14 | 27 | 41 | 69 |
| 29 | 0 | 13 | 26 | 39 | 70 |
| 30 | 0 | 15 | 28 | 43 | 67 |

TABLE II-continued

| Days on Stream | PPM Mo in Feed | (Run 1), (Control) PPM in Product Oil Ni | V | Ni + V | % Removal of Ni + V |
|---|---|---|---|---|---|
| 31 | 0 | 15 | 28 | 43 | 67 |
| 32 | 0 | 15 | 27 | 42 | 68 |

TABLE III

| Days on Stream | PPM Mo in Feed | (Run 2) (Control) PPM in Product Oil Ni | V | Ni + V | % Removal of Ni + V |
|---|---|---|---|---|---|
| | Mo (IV) octoate as Mo source | | | | |
| 3 | 23 | 16 | 29 | 45 | 66 |
| 4 | 23 | 16 | 28 | 44 | 67 |
| 7 | 23 | 13 | 25 | 38 | 71 |
| 8 | 23 | 14 | 27 | 41 | 69 |
| 10 | 23 | 15 | 29 | 44 | 67 |
| 12 | 23 | 15 | 26 | 41 | 69 |
| 14 | 23 | 15 | 27 | 42 | 68 |
| 16 | 23 | 15 | 29 | 44 | 67 |
| 17 | 23 | 16 | 28 | 44 | 67 |
| 20 | Changed to hydro-treated Mo (IV) octoate | | | | |
| 22 | 23 | 16 | 28 | 44 | 67 |
| 24 | 23 | 17 | 30 | 47 | 64 |
| 26 | 23 | 16 | 26 | 42 | 68 |
| 28 | 23 | 16 | 28 | 44 | 67 |

Referring now to Tables II and III, it can be seen that the removal of nickel plus vanadium remained fairly constant. No improvement was seen when untreated or hydrotreated (in the absence of a hydrogenation catalyst) molybdenum (IV) octoate was introduced with the feed in Run 2.

EXAMPLE II

Another Arabian heavy topped crude (650° F.+); containing about 36 ppm Ni, 109 ppm V, 12 ppm Fe, 4.1 weight-% S, 12.0 weight-% Ramsbottom C and 9.50 weight-% pentane insolubles) was hydrotreated in accordance with the described test procedure. The LHSV of the oil ranged from 0.96 to 1.09; the pressure was 2250 psig; the hydrogen feed rate was about 4800 SCF hydrogen per barrel of oil; and the temperature was about 765° F. (407° C.). The hydrofining catalyst was presulfided catalyst D. Treated molybdenum compound A was added to the feed for this run (run 3, Table IV).

TABLE IV

| Days on Stream | PPM Mo in Feed | (Run 3), (Invention) PPM in Product Oil Ni | V | Ni + V | % Removal of Ni + V |
|---|---|---|---|---|---|
| 2 | 18 | 13 | 28 | 41 | 72 |
| 3 | 18 | 15 | 27 | 42 | 71 |
| 4 | 18 | 14 | 25 | 39 | 73 |
| 5 | 18 | 14 | 25 | 39 | 73 |
| 6 | 18 | 14 | 26 | 40 | 72 |
| 8 | 18 | 12 | 24 | 36 | 75 |
| 10 | 18 | 12 | 21 | 33 | 77 |
| 12 | 18 | 12 | 21 | 33 | 77 |
| 15 | 18 | 12.5 | 19.5 | 32 | 78 |
| 18 | 18 | 13 | 20 | 33 | 77 |
| 20 | 18 | 13 | 20 | 33 | 77 |
| 22 | 18 | 13 | 22 | 35 | 76 |
| 25 | 18 | 13.5 | 21.5 | 35 | 76 |

Data in Table IV clearly show that the degree of metal removal was higher in invention run 3 than in control run 1 (Table I) without any molybdenum in the feed, as well as in Control run 2 (Table II) employing molybdenum (IV) octoate, either untreated or hydrotreated in the absence of a hydrogenation catalyst, in the feed.

The removal of sulfur in Run 3 ranged from about 68% to about 78%. The removal of Ramsbottom carbon ranged from about 42% to about 50%. The reduction of heavies (pentane insolubles) was about 57%. Nitrogen removal was not measured.

EXAMPLE III

A desalted Monagas pipeline oil (containing about 85 ppm Ni, 316 ppm V, 31 ppm Fe, 2.7 weight-% S and 11.1 weight-% Ramsbottom C) was hydrotreated in accordance with the described test procedure. The oil LHSV ranged from 1.01 to about 1.10; the pressure was about 2250 psig; hydrogen feed rate was about 4,800 SCF $H_2$ per barrel of oil; and the temperature was about 765° F. (407° C.). The hydrofining catalyst was presulfided catalyst D.

In the first part of run 4 (run 4A; Control) no Mo was added for 9 days. Then molybdenum compound B was added (run 4B; invention). Results are summarized in Table V.

TABLE V (Run 4A, Control; Run 4B, Invention)

| Days on Stream | PPM Mo in Feed | PPM in Product Oil Ni | V | Ni + V | % Removal of Ni + V |
|---|---|---|---|---|---|
| | Run 4A: No Molybdenum in Feed | | | | |
| 2 | 0 | 44 | 119 | 163 | 59 |
| 3 | 0 | 42 | 120 | 162 | 60 |
| 4 | 0 | 42 | 122 | 164 | 59 |
| 6 | 0 | 49 | 141 | 190 | 53 |
| 7 | 0 | 46 | 137 | 183 | 54 |
| 8 | 0 | 42 | 125 | 167 | 58 |
| 9 | 0 | 41 | 122 | 163 | 59 |
| | Run 4B: Changed to Molybdenum Compound B | | | | |
| 10 | 21 | 42 | 126 | 167 | 58 |
| 11 | 21 | 41 | 115 | 157 | 61 |
| 13 | 21 | 39 | 108 | 147 | 63 |
| 14 | 21 | 39 | 108 | 147 | 63 |
| 15 | 21 | 38 | 103 | 141 | 65 |
| 16 | 21 | 40 | 106 | 146 | 64 |
| 17 | 21 | 38 | 101 | 139 | 65 |
| 18 | 21 | 40 | 104 | 144 | 64 |
| 20 | 21 | 39 | 100 | 139 | 65 |
| 21 | 21 | 38 | 93 | 131 | 67 |

Data in Table V clearly show that the addition of molybdenum compound B to the feed resulted in a marked increase in the removal of nickel and vanadium from the heavy oil.

Sulfur removal ranged from about 61% to about 64% in Run 4A, and from about 56% to about 59% in Run 4B. Removal of Ramsbottom carbon ranged from about 29% to about 34% in Run 4A and was about 28–29% in Run 4B. The amount of heavies (pentane insolubles) was about 6.1 weight-% in the product of Run 4A and about 5.2–5.5 weight-% in the product of Run 4B. The amount of basic nitrogen was about 0.15 weight-% in the product of Run 4A and about 0.16 weight-% in the product of Run 4B.

Reasonable variations and modifications are possible within the scope of the disclosure and the appended claims to the invention.

That which is claimed is:

1. A process for hydrofining a hydrocarbon-containing feed stream which contains metals comprising the steps of:

introducing a treated, decomposable molybdenum compound into said hydrocarbon-containing feed stream, wherein said treated, decomposable molybdenum compound is prepared by reducing the valence state of a decomposable compound of molybdenum and wherein the molybdenum in said decomposable compound of molybdenum is in a valence state of +1 to +6 prior to reduction; and contacting said hydrocarbon-containing feed stream containing said treated, decomposable compound of molybdenum under hydrofining conditions with hydrogen and a catalyst composition comprising a support selected from the group consisting of alumina, silica and silica alumina and a promoter comprising at least one metal selected from Group VIB, Group VIIB and Group VIII of the Periodic Table.

2. A process in accordance with claim 1 wherein a sufficient quantity of said treated, decomposable compound of molybdenum is added to said hydrocarbon-containing feed stream to result in a concentration of molybdenum in said hydrocarbon-containing feed stream in the range of about 1 to about 60 ppm.

3. A process in accordance with claim 1 wherein a sufficient quantity of said treated decomposable compound of molybdenum is added to said hydrocarbon-containing feed stream to result in a concentration of molybdenum in said hydrocarbon-containing feed stream in the range of about 2 to about 20 ppm.

4. A process in accordance with claim 1 wherein the valence state of said decomposable compound of molybdenum is reduced by catalytically hydrogenating said decomposable compound of molybdenum in the presence of a hydrogenation catalyst selected from the group consisting of Rayney nickel; alumina or silica impregnated with Ni, Co, Pt, Pd, Ru, Rh, Cr, or Cu; copper chromite and nickel boride.

5. A process in accordance with claim 4 wherein said hydrogenation catalyst is an alumina catalyst promoted by nickel.

6. A process in accordance with claim 4 wherein the reaction time between the hydrogenation catalyst and said decomposable compound of molybdenum is in the range of about 0.5 hours to about 4 hours, the hydrogenation temperature is in the range of about 100° C. to about 300° C., the hydrogenation pressure is in the range of about 50 psig to about 1000 psig, and the hydrogen concentration is in the range of about 1 to about 10 moles of hydrogen per gram atom of chemically bound molybdenum.

7. A process in accordance with claim 4 wherein said decomposable compound of molybdenum is selected from the group consisting of aliphatic, cycloaliphatic and aromatic carboxylate compounds of molybdenum having 1–20 carbon atoms, diketone compounds of molybdenum, mercaptide compounds of molybdenum, xanthate compounds of molybdenum, carbonate compounds of molybdenum and dithiocarbamate compounds of molybdenum.

8. A process in accordance with claim 7 wherein said decomposable compound of molybdenum is a molybdenum carboxylate.

9. A process in accordance with claim 1 wherein the valence state of said decomposable molybdenum compound is reduced by treating said decomposable molybdenum compound with a reducing agent selected from the group consisting of hydrocarbyl aluminum compounds and metal hydrides.

10. A process in accordance with claim 9 wherein said reducing agent is triethyl aluminum.

11. A process in accordance with claim 9 wherein the time said decomposable compound of molybdenum is treated with said reducing agent is in the range of about 1 second to about 1 hour, the temperature at which said decomposable compound of molybdenum is treated with said reducing agent is in the range of about 20° C. to about 100° C. and the pressure at which said decomposable compound of molybdenum is treated with said reducing agent is in the range of of about 15 psia to about 150 psia.

12. A process in accordance with claim 9 wherein said decomposable compound of molybdenum is selected from the group consisting of aliphatic, cycloaliphatic and aromatic carboxylate compounds of molybdenum having 1–20 carbon atoms, diketone compounds of molybdenum, mercaptide compounds of molybdenum, xanthate compounds of molybdenum, carbonate compounds of molybdenum and dithiocarbamate compounds of molybdenum.

13. A process in accordance with claim 12 wherein said decomposable compound of molybdenum is a molybdenum carboxylate.

14. A process in accordance with claim 1 wherein said catalyst composition comprises alumina, cobalt and molybdenum.

15. A process in accordance with claim 14 wherein said catalyst composition additionally comprises nickel.

16. A process in accordance with claim 1 wherein said hydrofining conditions comprise a reaction time between said catalyst composition and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

17. A process in accordance with claim 1 wherein said hydrofining conditions comprise a reaction time between said catalyst composition and said hydrocarbon-containing feed stream in the range of about 0.4 hours to about 4 hours, a temperature in the range of 340° C. to about 440° C., a pressure in the range of about 500 to about 3,000 psig and a hydrogen flow rate in the range of about 1,000 to about 6,000 standard cubic feet per barrel of said hydrocarbon-containing feed stream.

18. A process in accordance with claim 1 wherein the adding of said treated, decomposable compound of molybdenum to said hydrocarbon-containing feed stream is interrupted periodically.

19. A process in accordance with claim 1 wherein said hydrofining process is a demetallization process and wherein said metals in said hydrocarbon-containing feed stream are nickel and vanadium.

* * * * *